US006955526B2

(12) United States Patent
Yamazaki et al.

(10) Patent No.: US 6,955,526 B2
(45) Date of Patent: Oct. 18, 2005

(54) VACUUM GENERATOR WITH FLOW SWITCHING MEANS FOR VARYING SUCTION CAPACITY THROUGH A PLURALITY OF NOZZLES

(75) Inventors: Kiyoyasu Yamazaki, Nagano (JP); Toshimasa Kitahara, Nagano (JP); Suminori Masuzawa, Nagano (JP); Masataka Funahashi, Osaka (JP)

(73) Assignee: Nihon Pisco Co., Ltd., Nagano (JP)

( * ) Notice: Subject to any disclaimer, the term of this patent is extended or adjusted under 35 U.S.C. 154(b) by 175 days.

(21) Appl. No.: 10/390,904

(22) Filed: Mar. 19, 2003

(65) Prior Publication Data

US 2003/0180154 A1 Sep. 25, 2003

(30) Foreign Application Priority Data

Mar. 19, 2002 (JP) ..... 2002-076447

(51) Int. Cl.[7] ..... F04B 5/48

(52) U.S. Cl. ..... 417/187; 417/186; 417/185; 417/182; 417/198; 417/166; 417/178

(58) Field of Search ..... 417/185, 182, 417/186, 187, 198, 190, 191, 163, 165, 166, 178

(56) References Cited

U.S. PATENT DOCUMENTS 283,229 A * 8/1883 Felthousen et al. ..... 417/162
1,528,760 A * 3/1925 Friedmann et al. ..... 417/165
1,858,325 A * 5/1932 Deutsch ..... 417/165
2,245,839 A * 6/1941 Tinker ..... 417/166
2,247,005 A * 6/1941 Trofimov ..... 417/165
4,880,358 A * 11/1989 Lasto ..... 417/174
5,683,227 A * 11/1997 Nagai et al. ..... 417/174
5,887,623 A * 3/1999 Nagai et al. ..... 137/884
6,182,702 B1 * 2/2001 Edlund et al. ..... 137/884
6,582,199 B1 * 6/2003 Volkmann ..... 417/178

FOREIGN PATENT DOCUMENTS

JP 61-55399 A 3/1986

* cited by examiner

*Primary Examiner*—Timothy S. Thorpe
*Assistant Examiner*—Emmanuel Sayoc
(74) *Attorney, Agent, or Firm*—Birch, Stewart, Kolasch & Birch, LLP

(57) ABSTRACT

The vacuum generator is capable of quickly and securely holding and releasing a work piece and capable of reducing amount of consuming compressed air. In the vacuum generator, a first nozzle and a second nozzle jet compressed air toward a diffuser nozzle. The second nozzle has a diameter greater than that of the first nozzle. Switching means switches a state of the vacuum generator between a first state, in which a small amount of air sucked from the vacuum port, and a second state, in which a large amount of air is sucked from the vacuum port. The first nozzle, the second nozzle and the diffuser nozzle are serially arranged in that order.

9 Claims, 5 Drawing Sheets

VACUUM GENERATOR WITH FLOW SWITCHING MEANS FOR VARYING SUCTION CAPACITY THROUGH A PLURALITY OF NOZZLES

BACKGROUND OF THE INVENTION

The present invention relates to a vacuum generator, which is used for, for example, a conveying device capable of holding a work piece by air suction, more precisely relates to a vacuum generator capable of reducing amount of compressed air and efficiently using compressed air.

A vacuum generator is assembled in a conveying device which holds a work piece by air suction. In the conventional vacuum generator, a vacuum state or a negative pressure state is generated in a vacuum port by using compressed air. The vacuum state is generated and disappeared by a switching valve, which controls the supply of compressed air. A work piece is sucked to the vacuum port when the vacuum state is generated in the vacuum port.

A sectional view of a conventional vacuum generator is shown in FIG. 6. The vacuum generator comprises: an air-supply port 10 to which compressed air is supplied; an air-discharge port 40 from which compressed air is discharged; and a vacuum port 50 in which a vacuum state or a negative pressure state is generated so as to hold a work piece. A main valve 60 is moved in the axial direction by a pilot valve 70. Communication between an air-supply path 12 and a first communication path 14 is controlled on the basis of positions of the main valve 60. While the air-supply path 12 and the first communication path 14 are communicated, the vacuum state is generated and the work piece can be held by air suction; while the air-supply path 12 and the first communication path 14 are not communicated, the vacuum state is disappeared and the work piece can be released.

A nozzle 18 is provided in a cylinder 16, and a diffuser nozzle 20 is provided on the front side of the nozzle 18. Compressed air introduced via the first communication path 14 is jetted from the nozzle 18, so that the vacuum state is generated in the vacuum port 50. A cylinder 52 is communicated to the cylinder 16 via a communication path 45. By jetting the compressed air from the nozzle 18 toward the diffuser nozzle 20, air is sucked through the cylinder 52 and the communication path 45, so that the work piece is sucked to the vacuum port 50.

To efficiently convey work pieces, the vacuum generator must hold and release the work piece in a short time. Holding and releasing work pieces are influenced by response and vacuum characteristics of the vacuum port. To quickly suck and hold the work piece, amount of sucking air must be large. However, a large amount of compressed air must be required so as to suck a large amount of air.

Conventionally, the vacuum generator is selected on the basis of following conditions: total capacity of a vacuum generating section including tubes, amount of compressed air to be consumed, capacity of a compressor, leakage from a connecting part between the work piece and an actuator, etc. However, the conditions are considered for sucking the work piece; amount of compressed air for holding the work piece is not considered. As described above, the work piece can be quickly and securely sucked to the vacuum port by sucking a large amount of air. However, after the work piece is once held, the work piece can be fully held by sucking a small amount of air, which supplements leakage of air in a vacuum circuit. Therefore, after the work piece is once held, amount of consuming compressed air can be reduced by reducing amount of air sucked. In the case of a vacuum generator whose nozzle has a large diameter, the amount of sucking air is large. And, in the case of a conveying device which takes a long time to convey the work piece, it is advantageous for energy reduction to reduce the amount of consuming compressed air.

Another conventional vacuum generator capable of sucking a large amount of air from a vacuum port is known. In the vacuum generator, a first ejector unit whose nozzle has a small diameter and a second ejector unit whose nozzle has a large diameter are arranged in series. The vacuum generator is capable of sucking a large amount of air, but amount of consuming compressed air is not reduced.

Further, a vacuum generator capable of reducing amount of consuming compressed air is known. In the vacuum generator, a first ejector unit, which is capable of generating a low degree vacuum state, and a second ejector unit, which is capable of generating a high degree vacuum state, are arranged in parallel. The ejector units are selectively actuated (see Japanese Patent Gazette No. 61-55399). However, by employing two ejector units, number of parts must be increased, and the vacuum generator must be large-sized.

SUMMARY OF THE INVENTION

An object of the present invention is to provide a compact vacuum generator capable of quickly and securely holding and releasing a work piece and capable of reducing amount of consuming compressed air.

To achieve the object, the present invention has following structures.

Namely, the vacuum generator of the present invention comprises:

an air-supply port to which compressed air is supplied;

a nozzle from which the compressed air is jetted toward a diffuser nozzle so as to suck air from a vacuum port; and an air-discharge port from which the compressed air is discharged, characterized by:

a first nozzle constituting the nozzle;

a second nozzle constituting the nozzle, the second nozzle having a diameter greater than that of the first nozzle;

a first communication path communicating the air-supply port to a base end of the first nozzle;

a second communication path communicating the air-supply port to a base end of the second nozzle; and means for switching a state of the vacuum generator between a first state, in which the air-supply port is connected to the first communication path so as to suck a small amount of air from the vacuum port, and a second state, in which the air-supply port is connected to the second communication path so as to suck a large amount of air from the vacuum port, wherein the first nozzle, the second nozzle and the diffuser nozzle are serially arranged in that order.

With this structure, the switching means is capable of selectively changing the state of the vacuum generator between the first state, in which a small amount of air is sucked, and the second state, in which a large amount of air is sucked. By selecting the second state, the work piece can be quickly and securely sucked and held; by selecting the first state, the work piece can be conveyed with a small amount of consuming compressed air. Namely, energy consumption can be reduced.

In the vacuum generator, a sucking path may be communicated to the vacuum port, the sucking path may be communicated to the second communication path by a third communication path, and a check valve may communicate the sucking path to the second communication path in the first state and shuts off the sucking path from communication with the second communication path in the second state.

In the vacuum generator, the switching means may include:

means for detecting pressure of the vacuum port; and a switching mechanism communicating the air-supply port to the second communication path when the detecting means detects low degree of vacuum in the vacuum port with no work piece sucked by the vacuum port, the switching mechanism communicating the air-supply port to the first communication path when the detecting means detects high degree of vacuum in the vacuum port with a work piece sucked by the vacuum port.

In the vacuum generator, the switching mechanism may include:

a first main valve closing a communication path communicating the air-supply port to the first communication path, the first main valve opening the communication path when the first main valve is actuated;

a second main valve closing a communication path communicating the air-supply port to the second communication path, the second main valve opening the communication path when the second main valve is actuated; and a pilot valve actuating the second main valve when the degree of vacuum in the vacuum port is low, the pilot valve actuating the first main valve when the degree of vacuum in the vacuum port is high.

In the vacuum generator, a pressure sensor may be provided to a sucking path communicating to the vacuum port so as to detect pressure in the vacuum port.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
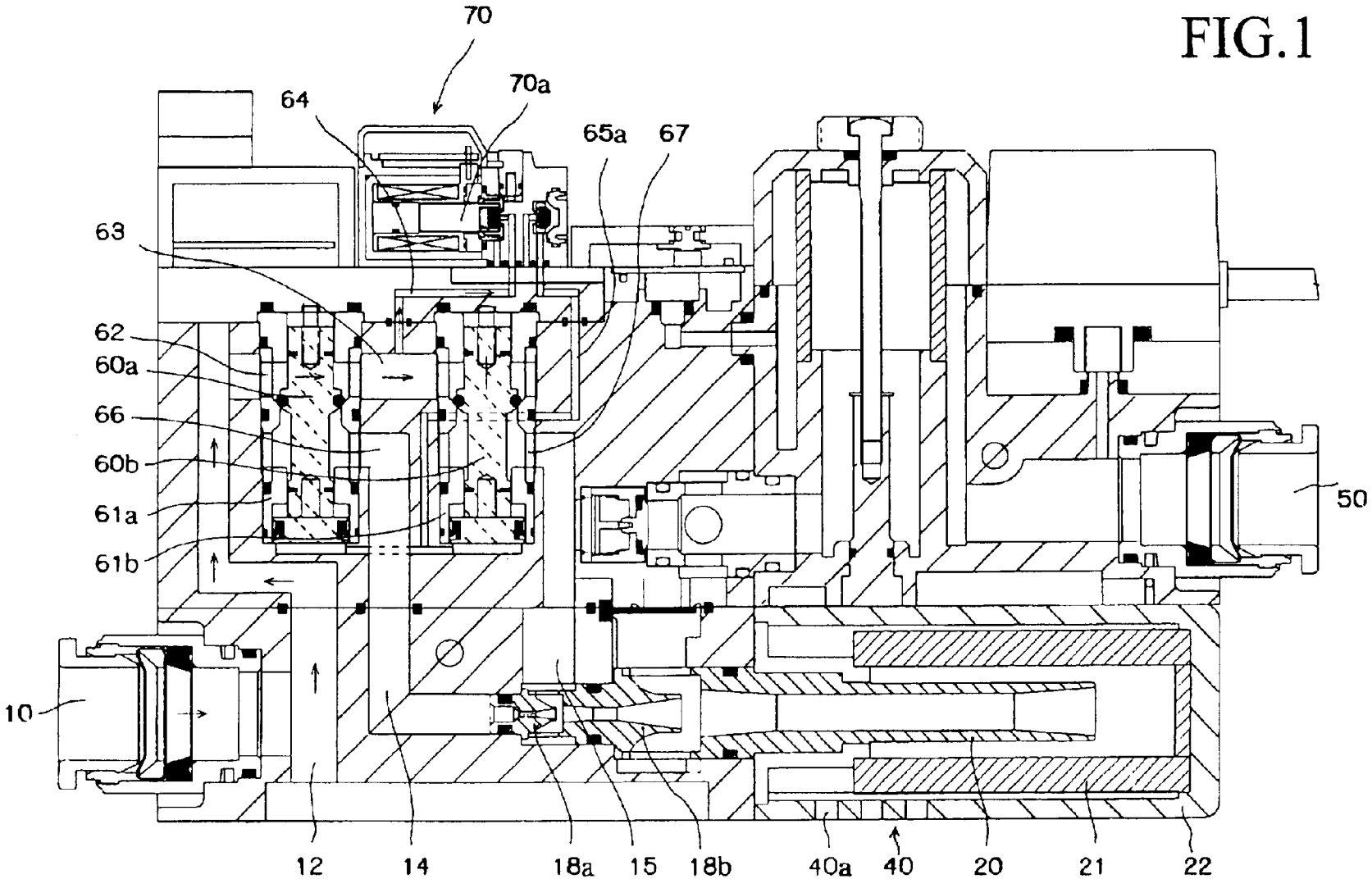
FIG. 1 is a sectional view of a vacuum generator of the present invention, in which no vacuum is generated.
Figure 2:
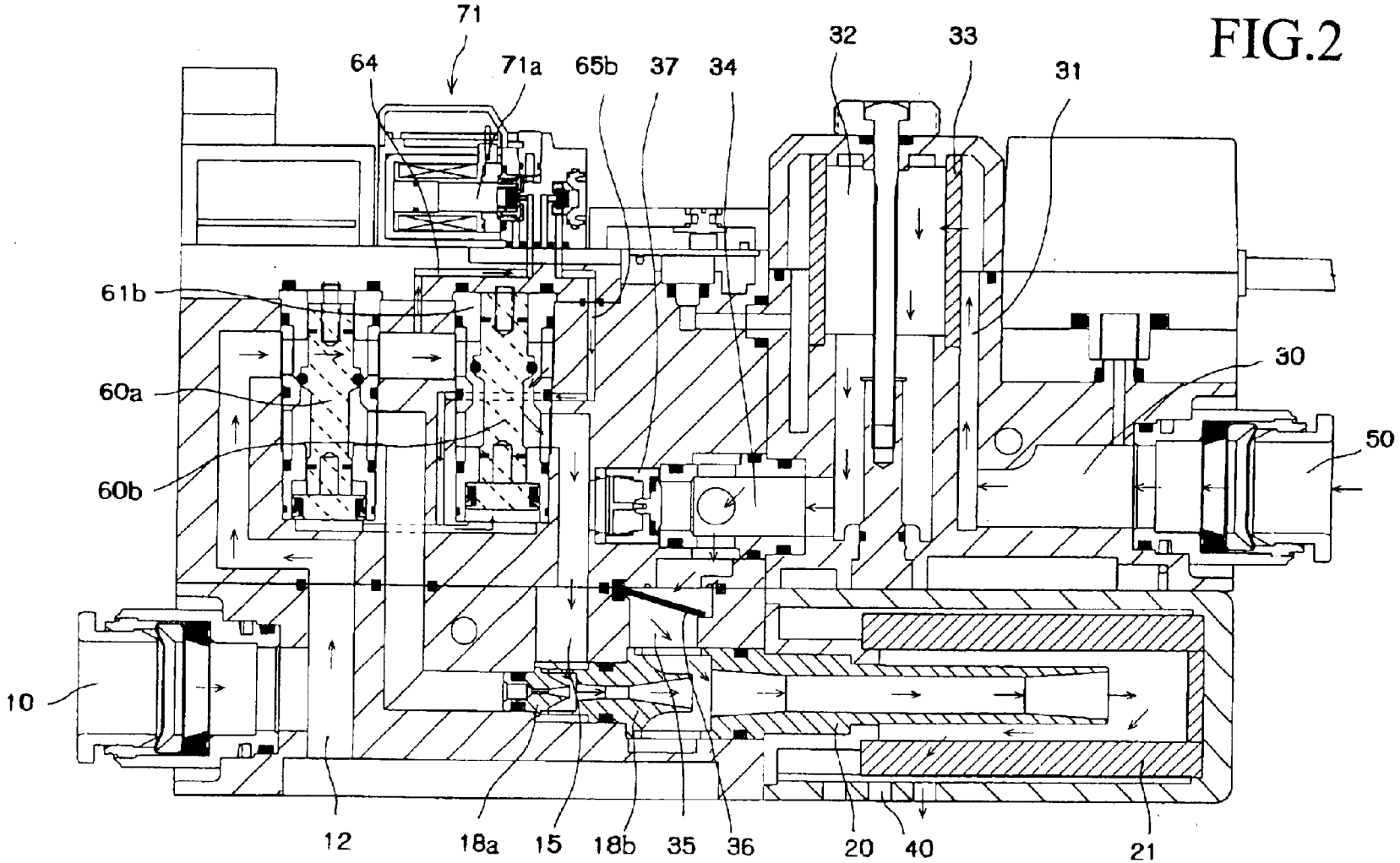
FIG. 2 is a sectional view of the vacuum generator, in which a work piece is sucked.
Figure 3:
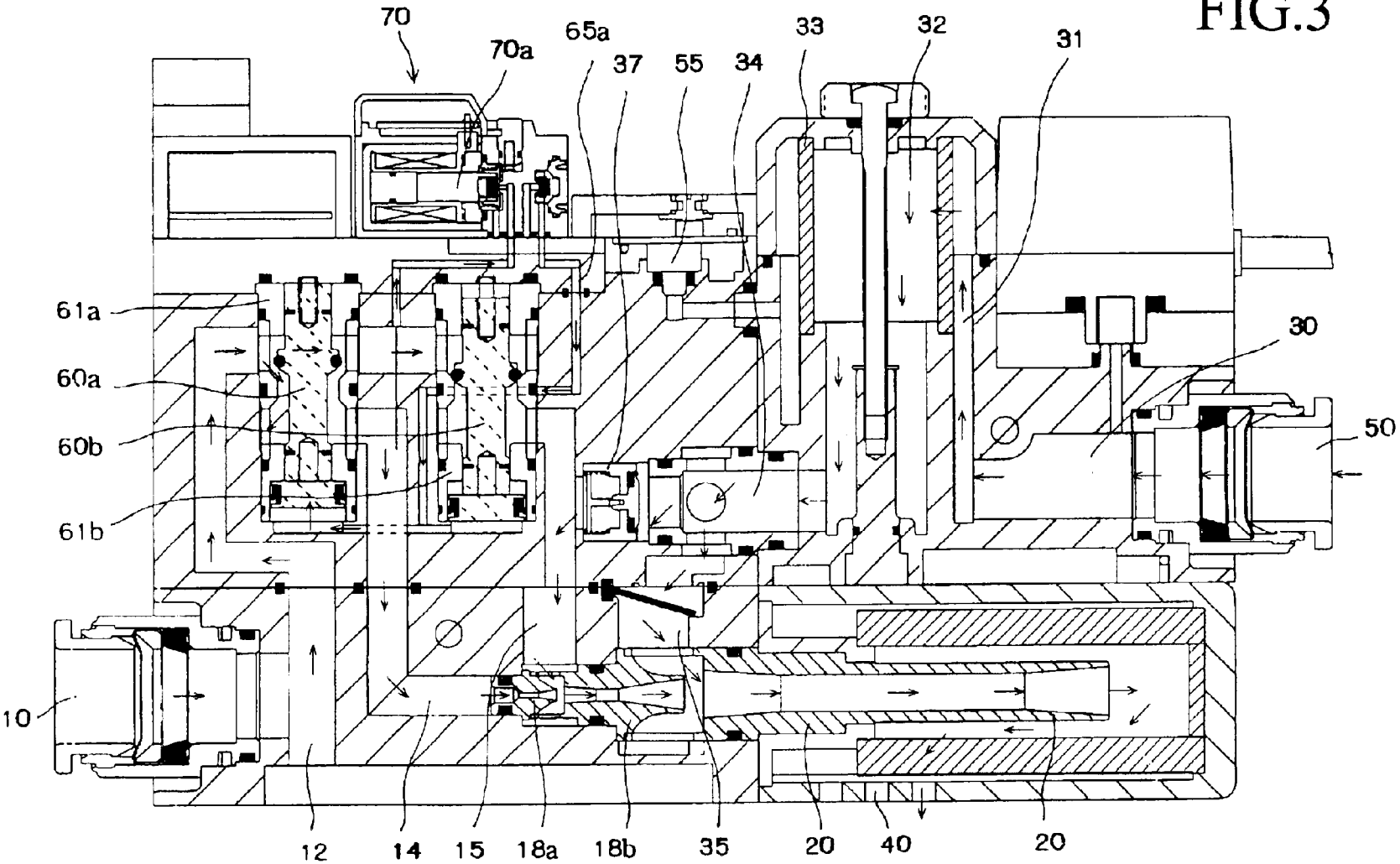
FIG. 3 is a sectional view of the vacuum generator, in which the work piece is held.

FIGS. 1–3 show an inner structure of a vacuum generator of an embodiment of the present invention. FIG. 1 shows a stand-by state in which no vacuum is generated; FIG. 1 shows a sucking state in which a large amount of air is sucked from a vacuum port to suck a work piece; and FIG. 3 shows a holding state in which the work piece is held with consuming a small amount of compressed air.

The states and action of the vacuum generator shown in FIGS. 1–3 will be explained.

Stand-by State

FIG. 1 shows the stand-by state in which no vacuum is generated. An air-supply port 10 is connected to a source of compressed air, e.g., a compressor. The air-supply port 10 is communicated to a supply path 12, which is communicated to a first main valve 60*a*. The supply path 12 is bent and upwardly extended, and it is communicated to a hole 62, which is opened in one side face of a cylinder 61*a* accommodating the first main valve 60*a*. The first main valve 60*a* is air-tightly fitted in the cylinder 61*a* and capable of moving in the axial direction thereof.

A second main valve 60*b*, which is the same as the first main valve 60*a*, is accommodated in a cylinder 61*b*, which is arranged parallel to the cylinder 61*a*. The second main valve 60*a* too is air-tightly fitted in the cylinder 61*b* and capable of moving in the axial direction thereof.

Figure 4:
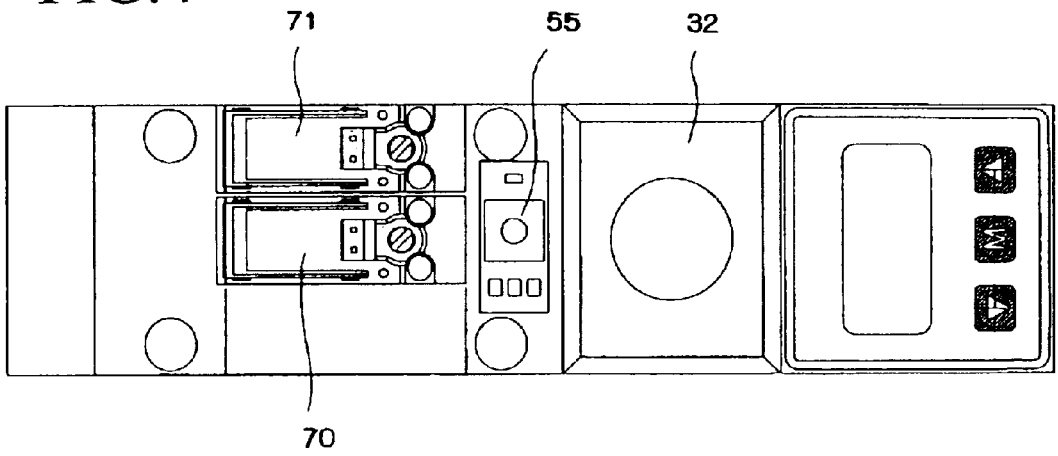
FIG. 4 is a plan view of the vacuum generator.

In the present embodiment, the first main valve 60*a* and the second main valve 60*b* are respectively controlled by two pilot valves. A plan view of the vacuum generator is shown in FIG. 4. The pilot valves 70 and 71 respectively control the motion of the first main valve 60*a* and the second main valve 60*b*.

Only the pilot valve 70 is shown in FIG. 1. The pilot valve 70 is communicated to a communication path 63, which communicates the cylinder 61*a* to the cylinder 61*b*, via a communication path 64. A communication path 65*a* communicates the pilot valve 70 to a bottom part of the cylinder 61*a*. The other pilot valve 71 is communicated to the communication path 63 via the communication path 64 and communicated to a bottom part of the cylinder 61*b* via a communication path 65*b*.

A first communication path 14 is communicated to a hole 66, which is opened in the other side face of the cylinder 61*a*. The first communication path 14 is bent and downwardly extended from the cylinder 61*a* to a base end of a first nozzle 18*a*. A second nozzle 18*b* is serially arranged with respect to the first nozzle 18*a*.

As described above, the vacuum generator of the present embodiment has two nozzles. As clearly shown in the drawing, a diameter of the second nozzle 18*b* is greater than that of the first nozzle 18*a*. With this structure, a large amount of compressed air can be jetted from the second nozzle 18*b*. On the other hand, a small amount of compressed air is jetted from the first nozzle 18*a*. Namely, the amount of compressed air passing through the first nozzle 18*a* is limited.

A second communication path 15 is communicated to a hole 67, which is opened in one side face of the cylinder 61*b*. The second communication path 15 is bent and downwardly extended from the cylinder 61*b* to a mid part between the first and second nozzles 18*a* and 18*b*. With this structure, the compressed air introduced in the second communication path 15 is jetted from the second nozzle 18*b*.

A diffuser nozzle 20 is provided on the front side of the second nozzle 18*b* and arranged coaxial with the first and second nozzles 18*a* and 18*b*. A silencer element 21 is attached on an inner face of a cylinder 22 so as to encloses a front end part of the diffuser nozzle 20. An air-discharge port 40 is opened in a side face of the cylinder 22. The air-discharge port 40 includes a plurality of through-holes 40*a*, which are formed in the side face of the cylinder 22.

FIG. 1 shows the stand-by state of the vacuum generator. Namely, no air is sucked from the vacuum port 50, so no work piece is sucked thereto.

In the stand-by state, valve bodies 70*a* and 70*b* close the pilot valves 70 and 71. When the valve bodies 70*a* and 70*b* close the pilot valves 70 and 71, the communication path 64 is isolated from the communication paths 65*a* and 65*b*, so that the first and second main valves 60*a* and 60*b* are moved downward. A down-force, which downwardly presses the first and second main valves 60*a* and 60*b* and which is generated by pressure of the compressed air flowing through the communication path 63, and an up-force, which upwardly presses the first and second main valves 60*a* and 60*b* and which is generated by pressure of the compressed air applied to bottom faces, work to the first and second main valves 60*a* and 60*b*. The first and second main valves 60*a* and 60*b* are moved downward and upward by difference of the down-force and the up-force.

When the first and second main valves 60*a* and 60*b* reach the lowermost positions, seal rings which are respectively provided to mid parts of the main valves 60*a* and 60*b* contact projections respectively provided in inner faces of the cylinders 61*a* and 61*b*, so that the seal rings prevents the compressed air from entering the first and second communication paths 14 and 15. With this action, the compressed air, which has been introduced into the air-supply port 10, cannot go forward from the supply path 12. Namely, the vacuum state is not generated.

Sucking State

FIG. 2 shows the sucking state of the vacuum generator, in which the work piece (not shown) is sucked to the vacuum port 50. When the vacuum generator sucks the work piece, air is sucked from the vacuum port 50.

The vacuum port is provided in a side face of the vacuum generator. The vacuum port 50 is communicated to a filtering chamber 32 via sucking paths 30 and 31. Air, which has been introduced into the filtering chamber 32 via the sucking paths 30 and 31, passes a filtering element 33, so that the clean air can be gained. The clean air is introduced into a base end of the diffuser nozzle 20 via a communication path 34 and a valve chamber 35.

The valve chamber 35 is communicated to a front end of the second nozzle 18*b* and the base end of the diffuser nozzle 20. When the compressed air is jetted from the second nozzle 18*b* toward the diffuser nozzle 20, air is sucked into the valve chamber 35 and discharged from the air-discharge port 40. A check valve 36, which passes air toward the air-discharge port 40 only, is provided in the valve chamber 35.

A check valve 37 controls communication between the communication path 34 and the second communication path 15. The check valve 37 is always biased, by a spring, to shut off the communication between the communication path 34 and the second communication path 15.

When the vacuum generator sucks the work piece, the pilot valve 71 is actuated to open the valve body 71*a*.

By opening the valve body 71*a*, the communication path 64 is communicated to the communication path 65*b*, and the compressed air is introduced into the bottom part of the second main valve 60*b*, so that the second main valve 60*b* is moved to the uppermost position. When the second main valve 60*b* is moved to the uppermost position, the cylinder 61*b*, which has been closed by the second main valve 61*b*, is opened, so that the cylinder 61*b* is communicated to the second communication path 15. Namely, by opening the valve body 71*a*, the compressed air, which has been introduced from the air-supply port 10, is introduced to the base end of the second nozzle 18*b* via the supply path 12, the cylinder 61*b* and the second communication path 15. The compressed air in the second communication path 15 presses the check valve 37 to close the communication path 34.

The compressed air, which has been introduced to the base end of the second nozzle 18*b*, is jetted toward the diffuser nozzle 20, so that vacuum or negative pressure is generated. With this action, air is sucked from the vacuum port 50 and introduced to the valve chamber 35, the communication path 34, the filtering chamber 32, and the sucking paths 30 and 31.

A diameter of the second nozzle 11*b* is greater than that of the first nozzle 18*a*, so a large amount of air is sucked from the vacuum port 50 in the state shown in FIG. 2. By sucking a large amount of air from the vacuum port 50, the work piece can be quickly and securely sucked to the vacuum port 50. In this state, the degree of vacuum in the vacuum port 50 is low.

Holding State

FIG. 3 shows the holding state, in which the work piece, which has been sucked to the vacuum port 50, is continuously held by the vacuum port 50. As described above, after the work piece is sucked and once held, the work piece can be held by sucking a small amount of air from the vacuum port 50. In the vacuum generator shown in FIG. 3, the amount of sucking air is limited, and the degree of vacuum in the vacuum port 50 is high.

As shown in FIG. 3, a pressure sensor 55 is communicated to the filtering chamber 32. The pressure sensor 55 always detects air pressure or the degree of vacuum in the vacuum port 50. When the air pressure in the vacuum port 50 is equal to or lower than prescribed pressure, the valve body 70*a* of the pilot valve 70 is opened, and the valve body 71*a* of the pilot valve 71 is closed. Namely, when the pressure sensor 55 detects that the air pressure in the vacuum port 50 is equal to or lower than the prescribed pressure, the valve body 70*a* is opened, so that the first main valve 60*a* is moved from the lowermost position to the uppermost position. On the other hand, the valve body 71*a* is closed, so that the second main valve 60*b* is moved from the uppermost position to the lowermost position. In FIG. 3, the first main valve 60*a* is opened, and the second main valve 60*b* is closed.

When the first main valve 60*a* is opened, the compressed air, which has been supplied to the air-supply port 10, is introduced into the first communication path 14 via the cylinder 61*a* including the first main valve 60*a*. At that time, the second main valve 60*b* closes the cylinder 61*b*, so that no compressed air is introduced into the second communication path 15.

By opening the first main valve 60*a* and closing the second main valve 60*b*, the compressed air, which has been supplied to the air-supply port 10, is jetted from the first nozzle 18*a* toward the diffuser nozzle 20. The diameter of the first nozzle 18*a* is shorter than that of the second nozzle 18*b*, so that amount of compressed air passing through the first nozzle 18*a* is smaller than that passing through the second nozzle 18*b*.

The compressed air is jetted from the first nozzle 18*a* toward the diffuser nozzle 20. With this action, vacuum or negative pressure is generated in a space between the first nozzle 18*a* and the second nozzle 18*b* and another space between the second nozzle 18*b* and the diffuser nozzle 20, so that air is sucked to the second communication path 15 and the valve chamber 35.

By the check valve 37 communicated to the communication path 34, no compressed air is introduced into the second communication path 15, so that negative pressure is produced in the second communication path 15. The check valve 37 is biased to close the communication path 34, but the check valve 37 is moved, against an elastic force of the spring, to open the communication path 34 due to the negative pressure in the second communication path 15, so that the communication path 34 is communicated to the second communication path 15. With this action, air can flow via the communication path 34 and the second communication path 15.

In the holding state, the compressed air is introduced to only the first nozzle 18*a*, which has the small diameter. Therefore, amount of consuming compressed air is small.

When the work piece is sucked to and once held by the vacuum port 50, the air pressure in the vacuum port 50 quickly falls down. When the pressure sensor 55 detects the low pressure in the vacuum port 50, the first and second main valves 60*a* and 60*b* are switched from the positions for sucking the work piece to the positions for holding the work piece. As described above, a large amount of compressed air is consumed in the second nozzle 18*b* having the great diameter when the vacuum port sucks the work piece. On the other hand, a small amount of compressed air is consumed in the first nozzle 18*a* having the small diameter when the vacuum port continuously holds the work piece, so that the amount of consuming the compressed air can be reduced.

In the vacuum generator of the present embodiment, a large amount of compressed air is used when the work piece is sucked, so that the work piece can be quickly and securely sucked. After the work piece is once held, the work piece can be continuously held with consuming a small amount of compressed air. Therefore, the work piece can be securely conveyed, and the compressed air can be efficiently consumed. Especially, in the case of a conveying device in which it takes a long time to convey the work piece, the vacuum generator is capable of much reducing the amount of consuming compressed air.

In the vacuum generator of the present embodiment, two nozzles 18*a* and 18*b* are provided. Therefore, the work piece is held by sucking function of the both nozzles 18*a* and 18*b*. Namely, unlike the vacuum generator in which two nozzles is selectively used to hold the work piece, the vacuum generator of the present embodiment is capable of securely holding the work piece.

If the vacuum generator has one nozzle, amount of consuming compressed air for holding the work piece is equal to that for sucking the work piece, so that the amount of consuming the compressed air cannot be reduced. On the other hand, the vacuum generator of the present invention has two nozzles 18*a* and 18*b* having different diameters, so that the amount of consuming the compressed air can be reduced.

As shown in FIGS. 1 and 4, the vacuum generator is made wholly flat and compact. Namely, the first and second nozzles 18*a* and 18*b* are arranged in series, so that the vacuum generating section of the vacuum generator can be small-sized. Further, paths are designed to efficiently arrange the members, e.g., the first and second main valves 60*a* and 60*b*, in a small area, so that the compact vacuum generator can be realized.

Figure 5:
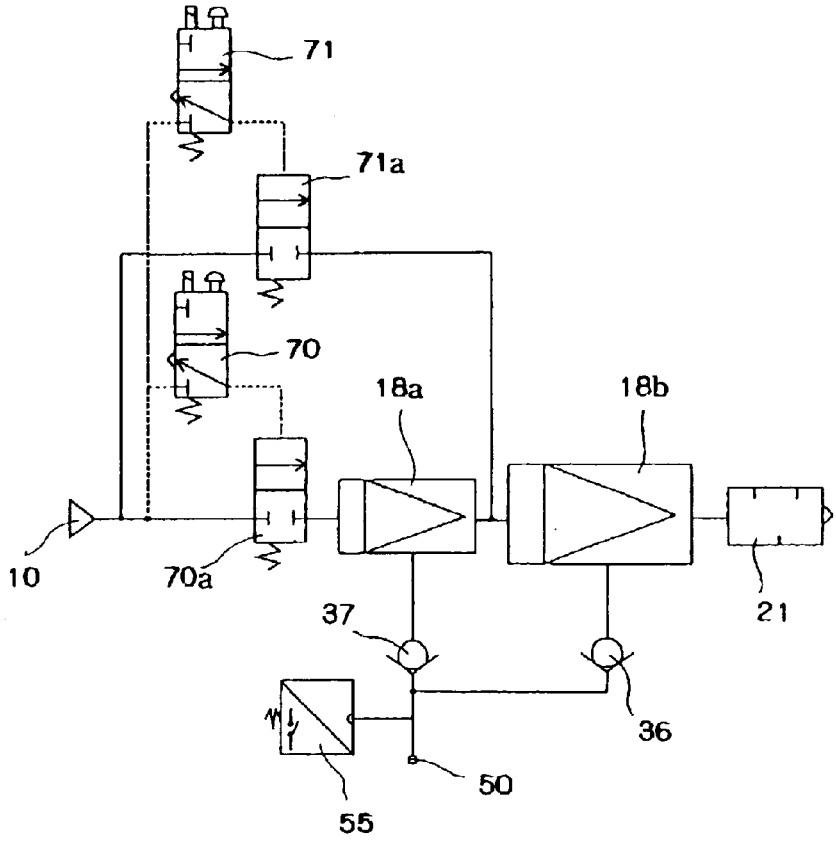
FIG. 5 is a circuit diagram of the vacuum generator.
Figure 6:
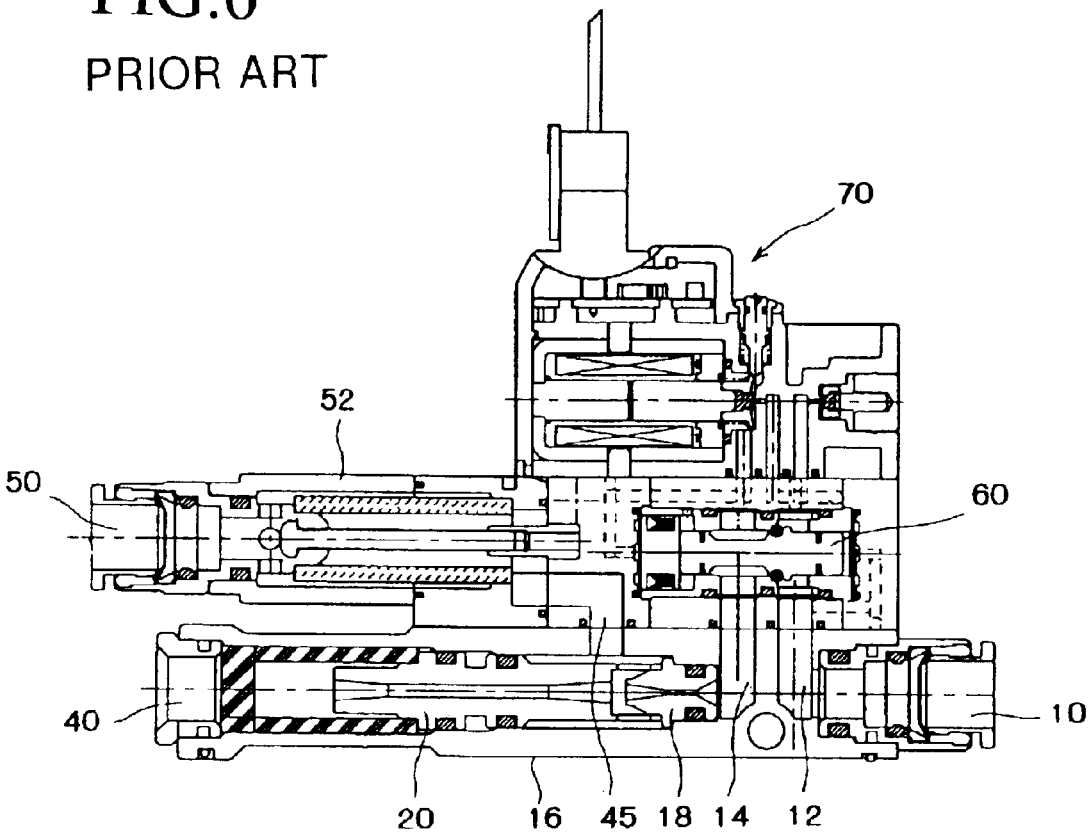
FIG.6 PRIOR ART
FIG. 6 is a sectional view of the conventional vacuum generator.

A circuit diagram of the vacuum generator is shown in FIG. 5. The compressed air is supplied to the air-supply port 10 so as to actuate the valve body 71*a* of the pilot valve 71, so that the compressed air is jetted from the second nozzle 18*b*, which is capable of jetting a large amount of the compressed air, and air can be sucked to the vacuum port 50. When the valve body 70*a* of the pilot valve 70 is actuated, the first and second nozzles 18*a* and 18*b* jet the compressed air, and air can be sucked to the vacuum port 50.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A vacuum generator, comprising:

an air-supply port to which compressed air is supplied;

a nozzle from which the compressed air is jetted toward a diffuser nozzle so as to suck air from a vacuum port; and an air-discharge port from which the compressed air is discharged, said nozzle including a first venturi nozzle and a second venturi nozzle, said second venturi nozzle having a diameter greater than that of said first venturi nozzle;

a first communication path communicating said air-supply port to a base end of said first venturi nozzle such that suction air from the vacuum port flows through the first venturi nozzle and through the second venturi nozzle;

a second communication path communicating said air-supply port to a base end of said second venturi nozzle such that suction air from the vacuum port flows only through the second venturi nozzle; and means for switching a state of said vacuum generator between a first state, in which said air-supply port is connected to said first communication path so as to suck a small amount of air from said vacuum port, and a second state, in which said air-supply port is connected to said second communication path so as to suck a large amount of air from said vacuum port, wherein said first venturi nozzle, said second venturi nozzle and said diffuser nozzle are serially arranged in that order.

2. The vacuum generator according to claim 1, wherein a sucking path is communicated to said vacuum port, said sucking path is communicated to said second communication path by a third communication path, and a check valve communicates said sucking path to said second communication path in the first state and shuts off said sucking path from communication with said second communication path in the second state.

3. The vacuum generator according to claim 1, wherein said switching means includes:

means for detecting pressure of said vacuum port; and a switching mechanism communicating said air-supply port to said second communication path when said detecting means detects low degree of vacuum in said vacuum port with no work piece sucked by said vacuum port, said switching mechanism communicating said air-supply port to said first communication path when said detecting means detects high degree of vacuum in said vacuum port with a work piece sucked by said vacuum port.

4. The vacuum generator according to claim 3, wherein said switching mechanism includes:

a first main valve closing a communication path communicating said air-supply port to said first communication path, said first main valve opening the communication path when said first main valve is actuated;

a second main valve closing a communication path communicating said air-supply port to said second communication path, said second main valve opening the communication path when said second main valve is actuated; and a pilot valve actuating said second main valve when the degree of vacuum in said vacuum port is low, said pilot valve actuating said first main valve when the degree of vacuum in said vacuum port is high.

5. The vacuum generator according to claim 3, wherein a pressure sensor is provided to a sucking path communicating to said vacuum port so as to detect pressure in said vacuum port.

6. A vacuum generator, comprising:

an air-supply port to which compressed air is supplied;

a nozzle from which the compressed air is jetted toward a diffuser nozzle so as to suck air from a vacuum port; and an air-discharge port from which the compressed air is discharged; said nozzle including a first venturi nozzle and a second venturi nozzle, said second venturi nozzle having a diameter greater than that of said first venturi nozzle;

a first communication path communicating said air-supply port to a base end of said first venturi nozzle such that suction air from the vacuum port flows through the first venturi nozzle and through the second venturi nozzle;

a second communication path communicating said air-supply port to a base end of said second venturi nozzle such that suction air from the vacuum port flows only through the second venturi nozzle; and means for switching a state of said vacuum generator between a first state, in which said air-supply port is connected to said first communication path so as to suck a small amount of air from said vacuum port, and a second state, in which said air-supply port is connected to said second communication path so as to suck a large amount of air from said vacuum port, said means for switching means induces:

means for detecting pressure of said vacuum port; and a switching mechanism communicating said air-supply port to said second communication path when said detecting means detects a low degree of vacuum in said vacuum port with no work piece sucked by said vacuum port, said switching mechanism communicating said air-supply port to said first communication path when said detecting means detects a high degree of vacuum in said vacuum port with a work piece sucked by said vacuum port;

wherein said first venturi nozzle, said second venturi nozzle and said diffuser nozzle are serially arranged in that order.

7. The vacuum generator according to claim 6, wherein a sucking path is communicated to said vacuum port;

said sucking path is communicated to said second communication path by a third communication path; and a check valve communicates said sucking path to said second communication path in the first state and shuts off said sucking path from communication with said second communication path in the second state.

8. The vacuum generator according to claim 6, wherein said switching mechanism includes:

a first main valve closing a communication path communicating said air-supply port to said first communication path, said first main valve opening the communication path when said first main valve is actuated;

a second main valve closing a communication path communicating said air-supply port to said second communication path, said second main valve opening the communication path when said second main valve is actuated; and a pilot valve actuating said second main valve when the degree of vacuum in said vacuum port is low, said pilot valve actuating said first main valve when the degree of vacuum in said vacuum port is high.

9. The vacuum generator according to claim 6, wherein a pressure sensor is provided to a sucking path communicating to said vacuum port so as to detect pressure in said vacuum port.

* * * * *